US005201601A

United States Patent [19]

Stanley et al.

[11] Patent Number: 5,201,601

[45] Date of Patent: Apr. 13, 1993

[54] BOARD MAT CONSTRUCTION

[76] Inventors: T. K. Stanley; Cary S. Farrar, both of P.O. Box 31, Waynesboro, Miss. 39367

[21] Appl. No.: 760,917

[22] Filed: Sep. 17, 1991

[51] Int. Cl.[5] ..... E01C 5/14; E01C 9/08

[52] U.S. Cl. ..... 404/35; 404/41; 404/46

[58] Field of Search ..... 404/35-36, 404/40-41, 46; 52/581

[56] References Cited

U.S. PATENT DOCUMENTS

| | | | |
|---|---|---|---|
| 1,970,037 | 8/1934 | Fischer | 404/46 X |
| 2,639,650 | 5/1953 | Robishaw | 404/35 |
| 2,652,753 | 9/1953 | Smith | 404/41 |
| 2,819,026 | 1/1958 | Leyendecker | 404/41 X |
| 4,289,420 | 9/1981 | Davis et al. | 404/35 |
| 4,600,336 | 7/1986 | Waller, Jr. | 404/46 X |
| 4,973,193 | 11/1990 | Watson et al. | 404/46 X |

*Primary Examiner*—Terry Lee Melius

*Assistant Examiner*—Nancy P. Connolly

*Attorney, Agent, or Firm*—Jacobson, Price, Holman & Stern

[57] ABSTRACT

A roadway/platform mat construction is provided for disposition over soft ground. The mat construction includes a rectangular, panel-like mat structure including opposite transverse end margins and opposite side longitudinal margins. The mat construction defines a first rectangular surface and a second rectangular surface facing opposite and paralleling the first surface and including elongated transverse log structures carried by the opposite ends of the mat structure and projecting outwardly of the second surface thereof. The transverse logs are of a width measured longitudinally of the mat construction equal to substantially one-quarter the length of the mat construction and the spacing between opposite end logs of each mat construction measured longitudinally thereof is equal to substantially one-half the length of the mat construction.

11 Claims, 2 Drawing Sheets

BOARD MAT CONSTRUCTION

BACKGROUND OF THE INVENTION

1. Field of the Invention

This invention relates to a mat to be constructed of wood or wood products and to be used in vertically and horizontally lapped relation in order to form a roadway or platform mat upon soft ground.

2. Description of Related Art

Various different forms of board mat constructions heretofore have been provided such as those disclosed in U.S. Pat. Nos.: 1,970,037, 2,639,650, 2,652,753, 2,819,026, 2,912,909, 4,289,420, 4,462,712 and 4,600,336. However, these various different forms of mat constructions, in many instances, do not provide sufficient ground traction between the mat constructions and the underlying ground surface and between the upper surface of the mat construction and a vehicle moving thereover. Furthermore, these previously known mat constructions may not be readily mass produced at low cost and the spacing of multiple transverse members thereof spaced along the length of the mat require spacing jigs in order to effect mass production. In addition, many of these previously known forms of mat constructions require extensive cleaning after each usage on soft ground and are difficult to correctly assemble when laying down a mat construction.

SUMMARY OF THE INVENTION

The mat construction of the instant invention, basically, includes a single rectangular planar surface defining member and only a single pair of transverse logs or members secured to and extending transversely of the opposite ends of the surface defining member.

When forming a roadway or platform a plurality of mat constructions are disposed with their surface defining member uppermost and their transverse logs or members lowermost and other mat constructions of the roadway or platform are inverted and disposed beneath the first mentioned mat constructions.

All of the mat constructions are of the same length and width and the transverse logs or members each have a width slightly less than one-quarter the length of the corresponding surface defining member and are spaced apart slightly greater than one-half the length of the corresponding surface defining member.

The inverted members, with the surface defining member lowermost and the transverse logs or members uppermost are first laid upon the ground in end-to-end aligned relation and the other mat constructions are then disposed over the inverted mat constructions with the spacing between the transverse end logs or members of each of the upper mat constructions receiving therein the adjacent transverse logs or members of adjacent ends of inverted mat constructions and the spacing between the transverse end logs or members of each lower mat construction receiving therein the adjacent transverse end logs or members of adjacent ends of the upper mat constructions.

The main object of this invention is to provide a mat construction for use in forming a roadway or platform on soft ground with a minimum amount of expense, transportation costs, difficulty in assembling the individual mat constructions in order to form a roadway or platform and ease of removal of the mat constructions after usage and cleaning thereof prior to subsequent usage.

Another object of this invention is to provide a mat construction in accordance with the preceding objects which will afford ground traction between the lower mat constructions and the ground upon which they are disposed.

Another object of this invention is to provide mat constructions formed in a manner such that surface traction of the upper mat constructions of a roadway or platform being with the wheels of vehicles traveling thereover may be increased.

Another very important object of this invention is to provide a mat construction which may be produced at low cost.

Still another object of this invention is to provide a mat construction of simple design which does not require the use of jigs during a mass production thereof.

A further object of this invention is to provide a mat construction which may be of one piece, molded construction.

A still further object of this invention is to provide a mat construction which will require minimum cleaning after each usage upon soft ground.

Yet another object of this invention is to provide a mat construction which may be molded primarily of wood products and resin.

Another object of this invention is to provide a platform mat construction of substantially eight feet in width and which may be made double wide to provide for a single lane roadway with the usual less than eight foot spacing between the wheels of vehicles serving to minimize downward depression of the outer margins of the roadway beneath soft ground over which the roadway is formed.

A final object of this invention to be specifically enumerated herein is to provide a mat construction which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
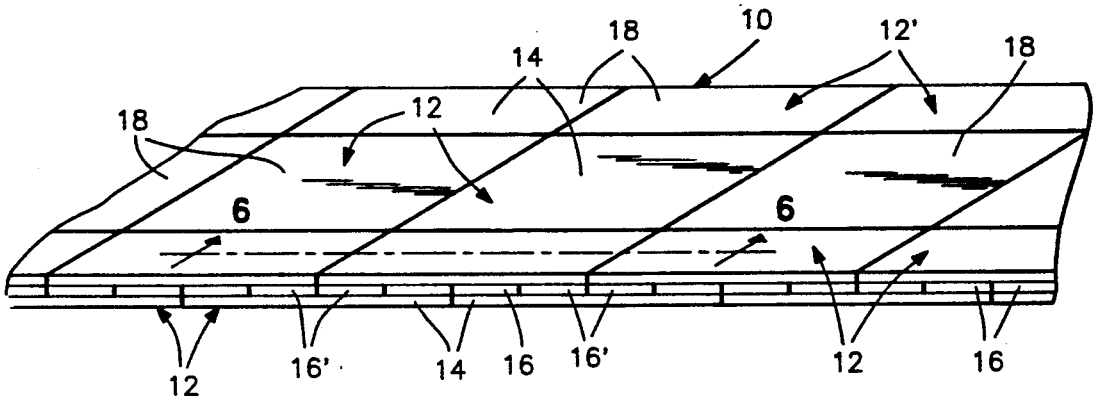
FIG. 1 is fragmentary perspective view of a double wide roadway constructed through the utilization of a plurality of right side up and inverted mat constructions of the instant invention and wherein the rectangular planar surface defining member of each mat construction is formed by a single unbroken panel member.

Referring now more specifically to the drawings the numeral 10 generally designates a roadway which has been constructed over soft ground utilizing a plurality of mat constructions of the instant invention.

Each mat construction is referred to in general by the reference numeral 12 or 12' and includes a rectangular surface defining member 14 or 14' and a pair of opposite end elongated transverse logs or members 16 or 16'.

Each rectangular surface defining member 14 defines a first rectangular surface 18 and a second rectangular surface 20 facing opposite and paralleling the first surface 18. In addition, each transverse log or member 16 is secured to the opposite ends of the rectangular surface defining member 14 in any convenient manner.

The mat constructions 12' are identical to the mat constructions 12, except that the mat constructions 12' are one-half the width of the mat constructions 12.

The mat constructions 12 and 12' utilize one piece rectangular surface defining members 14 and 14' one piece transverse logs or members 16 and 16'.

When the mat constructions 12 and 12' have their first rectangular surfaces 18 and 18' disposed uppermost, the transverse logs or members 16 and 16' are secured to the undersides of the rectangular surface defining members 14 and 14'. However, when constructing the roadway 10, some mat structures 12 and also the mat structures 12' are disposed with their first rectangular surfaces 18 disposed uppermost and other mat structures 12 are disposed with their first rectangular surfaces 18 disposed lowermost.

Figure 6:
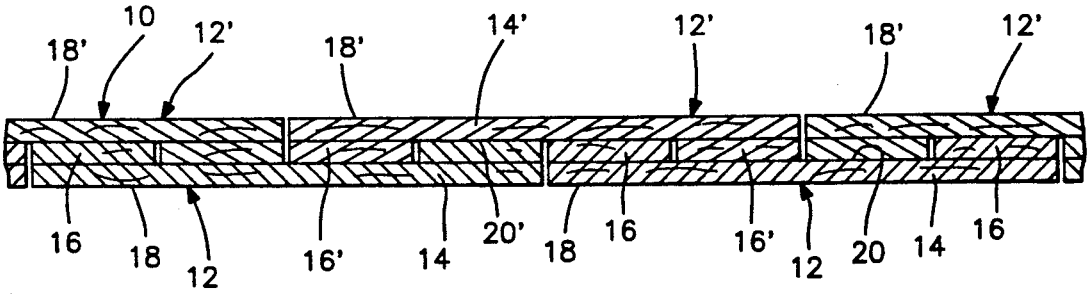
FIG. 6 is an enlarged fragmentary vertical sectional view taken substantially upon the plane indicated by the section line 6—6 of FIG. 1.
Figure 7:
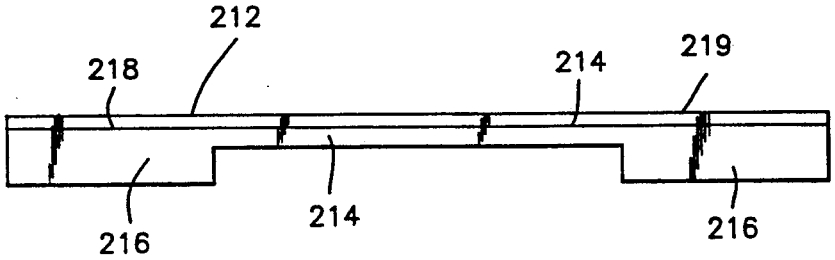
FIG. 7 is a reduced side elevational view of the one piece mat construction illustrated in FIGS. 4 and 5.

The width of the transverse logs or members 16 and 16' is slightly less than one-quarter the length of the rectangular surface defining member 14 and 14' and the spacing between the transverse logs or members 16 and 16' of each mat structure 12 and 12' is slightly greater than one-half the length of the corresponding rectangular surface defining member 14 and 14'. In this manner, when constructing the roadway 10, a double row of mat structures 12 are disposed in end-to-end aligned and abutted relation with their second rectangular surfaces 20 and their transverse logs or members 16 disposed uppermost, see FIG. 6. Thereafter, a first row of mat structures 12 with their first rectangular surfaces 18 disposed uppermost and their transverse logs or members 18 disposed lowermost are centered over the first laid two rows of mat structures 12 in end-to-end aligned and abutting relation with the adjacent transverse logs or members of end abutted upper mat sections 12 received between the transverse logs or members 16 of the lower mats 12 and the transverse logs or members 16 of abutted ends of lower mats 12 received in the spacing between the transverse logs or mats 16 of the upper mat structures 12. Then, two rows of one-half width mat constructions 12' are disposed over the exposed remote side half marginal portions of the first laid two rows of mat constructions 12 with the half width mat constructions 12' aligned transversely of the roadway 10 with the corresponding upper mat structures. In this manner, the upper and lower mat structures 12 and 12' are tightly interlocked together against relative longitudinal shifting and the friction between the upper and lower mat structures 12 and 12' strongly resists relative lateral shifting between upper and lower mat sections 12 and 12'. Further, when a vehicle with slightly less than eight foot spacing between opposite side wheels is driven down the center of the roadway 10 on the center row of upper mat structures 12, the weight of the vehicle is supported more from the adjacent margins of the underlying bottom mat structures 12 and, thus, there is little tendency for soft mud at the longitudinal margins of the roadway 10 to bulge up and overflow the roadway longitudinal margins.

The mat sections 12 and 12' may be constructed entirely of wood with the transverse logs or members 16 and 16' comprising large transverse planks and with the rectangular surface defining members comprising heavy plywood panel sections, both the rectangular surface defining members 14 and 14' and the transverse log or members 16 and 16' being treated against rot.

Figure 2:
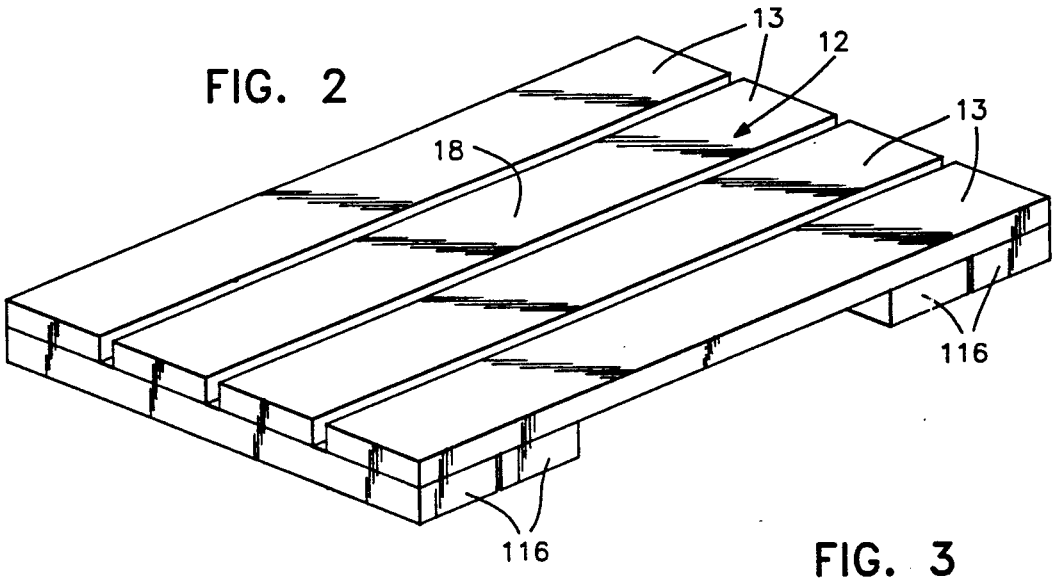
FIG. 2 is a perspective view of a modified form of mat construction wherein the rectangular planar surface defining member is constructed of four plank-type members and wherein each transverse log or member at the opposite ends of rectangular surface defining member is formed of a pair of closely spaces transverse plank members.
Figure 3:
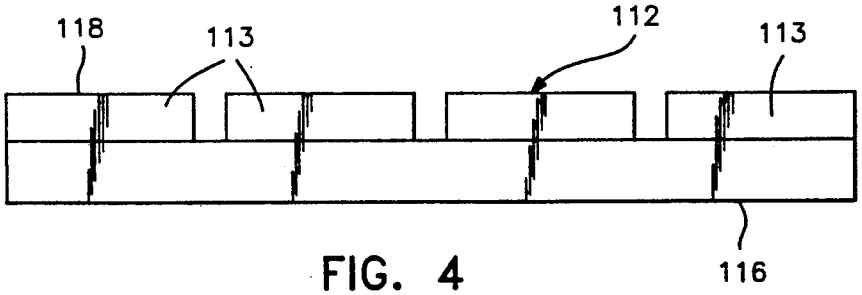
FIG. 3 is an enlarged end elevational view of the mat construction illustrated in FIG. 2.

With attention now invited more specifically to FIG. 2 of the drawings, there may be seen a modified form of mat structure 112 which utilizes four individual plank sections 113 as the rectangular surface defining member thereof and a pair of plank members 116 defining each of the transverse logs or members thereof. The plank members 113 are slightly spaced apart to allow heavily laden rubber tire areas aligned with the spacing between adjacent plank members 113 to be depressed downwardly between adjacent planks 113 in order to increase traction between the tires of wheeled vehicles and the first rectangular surface 118 of the mat structure 112. Here again, the plank members 113 and 116 may be constructed of wood or even molded of wood products mixed with resin. Of course, the mat structure 112 also may be constructed as a one-half mat structure and used in the same manner as the mat structure 12'.

Figure 4:
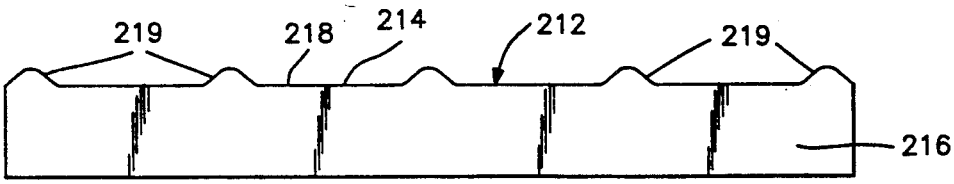
FIG. 4 is an end elevational view of a one piece mat construction wherein the rectangular surface defining member and the transverse logs are integrally formed by a molding process.
Figure 5:
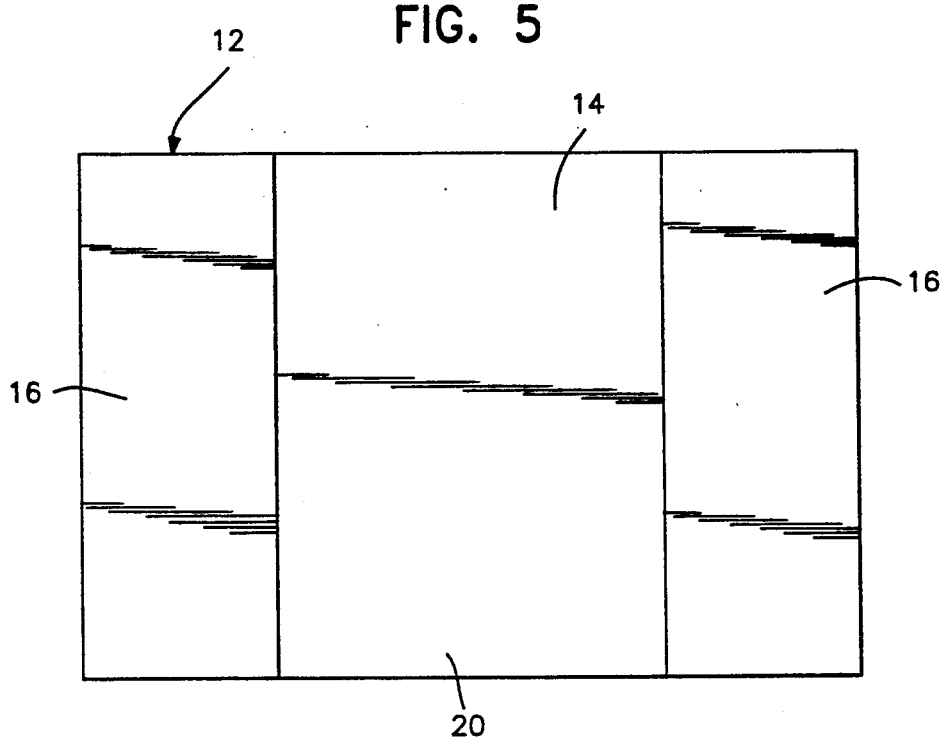
FIG. 5 is a reduced bottom plan view of the mat construction illustrated in FIG. 4.

Referring now more specifically to FIG. 4, the reference numeral 212 refers to a third form of mat structure which is of one piece construction and constructed of a mixture of wood chips and resin, or the like. The first rectangular surface 218 of the mat structure 212 includes four integral longitudinally extending, transversely spaced and generally inverted V-shaped ridges 219 for increasing traction between a wheeled vehicle and the first rectangular surface 218. The transverse logs or members 216 or formed integrally with the rectangular surface defining member 214 of the mat structure 212. The ridges 219, in addition to affording increased traction between the first rectangular surface 218 and wheeled vehicles moving thereover, also provide longitudinal stiffening for the mat structure 212. Also, as before, the mat structure 212 may be constructed as a one-half width mat structure.

It has been found that utilizing only two transverse logs or members at the opposite ends of each mat section 12 or 12' results in simplified construction of the mat sections 12 and 12', as opposed to mat sections previously known which incorporate more than two transverse log members or planks and which are interdigitated with relatively inverted mat sections of the same type. Previous mat sections utilizing more than two log members must be constructed through the utilization of jigs to insure proper spacing between the transverse log members and they are more difficult to clean after usage on soft ground to insure that the interdigitation of the log members of relatively inverted mat sections subsequently may be accomplished.

With applicant's invention it is only necessary to provide the rectangular surface defining members 14 and 14' and transverse logs or members 16 and 16' of the correct dimensions. Then, the transverse logs or members 16 and 16' may be readily secured to the opposite ends of the rectangular surface defining members 14 and 14', inasmuch as the transverse logs or members are substantially aligned with the end edges of the rectangular surface defining members 14 and 14' and the opposite side longitudinal margins of the rectangular surface defining members 14 and 14'. This type of construction enables the mat structures 12 and 12' to be assembled by persons having minimum education and instruction while still providing a product which is superior in its ability to be quickly erected in order form a roadway such as the roadway 10 and also its ability to be readily cleaned for subsequent usage.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A board mat construction for soft ground, said mat construction including a plurality of rectangular, panel-like first and second mat structures, said mat structures each including opposite transverse end margins and opposite side longitudinal margins and defining a first rectangular surface, a second rectangular surface facing opposite and paralleling said first surface, said second surface including a pair of opposite end portion elongated long structures disposed transverse to the corresponding mat structure having remote longitudinal sides generally flush with said end portions and opposite ends generally flush with said longitudinal margins, the area of said second surface between each pair of log structures being substantially rectangular and of a length, taken longitudinally of said mat, substantially equal to one-half the length of said mat, the width of said log structures being substantially equal to one-fourth the length of said mat, the surfaces of said log structures facing in the direction of said second surface being generally co-planar and spaced a predetermined distance outward of said second surface, said first mat structures being arranged in a first row of end abutted and aligned first mat structures with said first surfaces thereof facing upwardly, said second mat structures being arranged in a second row of end abutted and aligned second mat structures with said second mat structures disposed in one-half lengthwise staggered relation relative to said first mat structures and with said first surfaces of said second mat structures facing downwardly and the end log structures of adjacent ends of said second mat structures snugly received upwardly into the spacing of the first mat structure disposed thereabove between the end log structures thereof and the end log structures of adjacent ends of said first mat structures being snugly received downwardly into the spacing of the second mat structure disposed therebelow between the end log structures thereof.

2. The board mat construction of claim 1 wherein said first and second surfaces of said mat structures are defined by upper and lower surfaces of side-by-side plank members extending longitudinally of said mat structures and said log structures of each mat structure are formed separately from and anchored to the corresponding ends of said plank members.

3. The board mat construction of claim 2 wherein each of said log structures comprise multiple side-by-side side log members each anchored to the corresponding plank member ends.

4. The board mat construction of claim 2 wherein each of said log structures comprises a single log member anchored to the corresponding plank member ends.

5. The board mat construction of claim 1 wherein said first and second surfaces of said mat structures are defined by upper and lower surfaces of a single panel member structure spanning between the corresponding log structures.

6. The board mat construction of claim 5 wherein each of said log structures comprises a single log member anchored to the corresponding plank member ends.

7. The board mat construction of claim 5 wherein said log structures are integrally formed with the corresponding panel member structure.

8. The board mat construction of claim 5 wherein said upper surface of said single panel member structure includes a plurality of integral upwardly projecting, transversely spaced, and longitudinally extending reinforcing and traction increasing ribs.

9. The board mat construction of claim 8 wherein said log structures are integrally formed with the corresponding panel member structure.

10. The board mat construction of claim 1 wherein said mat structures are substantially eight feet in transverse width and between eight and twelve feet in length.

11. The board mat construction of claim 1 including additional mat structures corresponding to said first and second mat structures, but of a width substantially only one-half the width of said first and second mat structures, a third row of said first mat structures disposed closely alongside and paralleling said first row of mat structures and transversely aligned therewith, said second row of said second mat structures being centered, laterally, over said first and second rows, and two additional rows of said one-half width additional mat structures disposed over the remote half width portions of said first and third rows with the additional mat structures of said additional rows transversely aligned with the second mat structures of said second row.

* * * * *